US011325375B2

(12) United States Patent
Christensen et al.

(10) Patent No.: US 11,325,375 B2
(45) Date of Patent: May 10, 2022

(54) POTENTIAL PRINTHEAD STRIKE DETERMINATION

(71) Applicant: Hewlett-Packard Development Company, L.P., Spring, TX (US)

(72) Inventors: Tanner D. Christensen, Corvallis, OR (US); Matthew James West, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 28 days.

(21) Appl. No.: 16/982,744

(22) PCT Filed: Apr. 30, 2018

(86) PCT No.: PCT/US2018/030284
§ 371 (c)(1),
(2) Date: Sep. 21, 2020

(87) PCT Pub. No.: WO2019/212511
PCT Pub. Date: Nov. 7, 2019

(65) Prior Publication Data

US 2021/0039384 A1 Feb. 11, 2021

(51) Int. Cl.
*B41J 2/045* (2006.01)
*B41J 29/393* (2006.01)

(52) U.S. Cl.
CPC ..... *B41J 2/04581* (2013.01); *B41J 2/04535* (2013.01); *B41J 2/04573* (2013.01); *B41J 29/393* (2013.01)

(58) Field of Classification Search
CPC ... B41J 2/0451; B41J 2/04565; B41J 2/16579
See application file for complete search history.

(56) References Cited

U.S. PATENT DOCUMENTS

| | | | |
|---|---|---|---|
| 6,199,969 | B1 | 3/2001 | Haflinger et al. |
| 6,760,053 | B2 | 7/2004 | Rother |
| 6,866,359 | B2 | 3/2005 | Pan et al. |
| 7,614,717 | B2 | 11/2009 | Deng |

(Continued)

FOREIGN PATENT DOCUMENTS

| | | |
|---|---|---|
| CA | 2278881 | 1/2000 |
| EP | 0750251 | 12/1996 |
| WO | WO-2004068334 | 8/2004 |

*Primary Examiner* — Scott A Richmond
(74) *Attorney, Agent, or Firm* — Mannava & Kang

(57) ABSTRACT

According to examples, an apparatus may include a processor and a memory on which are stored machine readable instructions. The instructions, when executed by the processor, may cause the processor to access a property value respectively corresponding to each of a plurality of firing actuators in a printing system and determine a count of the firing actuators having property values that are outside of a predefined threshold value range. Based on the count exceeding a predefined maximum threshold value, the instructions may cause the processor to determine locations of the plurality of the firing actuators having property values that are outside of the predefined threshold value range, determine a standard deviation of the determined locations, and based on the determined standard deviation being below a predetermined threshold, output an indication concerning a potential printhead strike.

15 Claims, 7 Drawing Sheets

(56) References Cited

U.S. PATENT DOCUMENTS

| | | | | |
|---|---|---|---|---|
| 2006/0055745 | A1* | 3/2006 | Yagi | B41J 2/14233 347/71 |
| 2012/0001966 | A1* | 1/2012 | Hoisington | B41J 2/16579 347/6 |
| 2012/0223988 | A1* | 9/2012 | Matsuura | B41J 2/14209 347/12 |

* cited by examiner

POTENTIAL PRINTHEAD STRIKE DETERMINATION

BACKGROUND

Printing systems may include printheads having arrays of firing actuators that are controlled to print droplets of printing material, e.g., ink, onto particular locations on a recording medium (e.g., sheet of paper, build material particles, etc.) in order to print an intended image or a three-dimensional (3D) object. In some types of printing systems, the array of firing actuators extends across the width of the recording medium. In these types of printing systems, the firing actuators may be moved past the recording medium and/or the recording medium may be moved past the firing actuators. In other types of printing systems, the printhead or printheads are mounted on a carriage that is moved past the recording medium in a carriage scan direction as the firing actuators are actuated to make a swath of printed dots. At the end of the swath, the carriage is stopped; printing is temporarily halted, the recording medium is advanced and this process is repeated. The intended image is printed swath by swath onto the recording medium.

BRIEF DESCRIPTION OF THE DRAWINGS

Features of the present disclosure may illustrated by way of example and not limited in the following figure(s), in which like numerals indicate like elements, in which.

DETAILED DESCRIPTION

Figure 1:
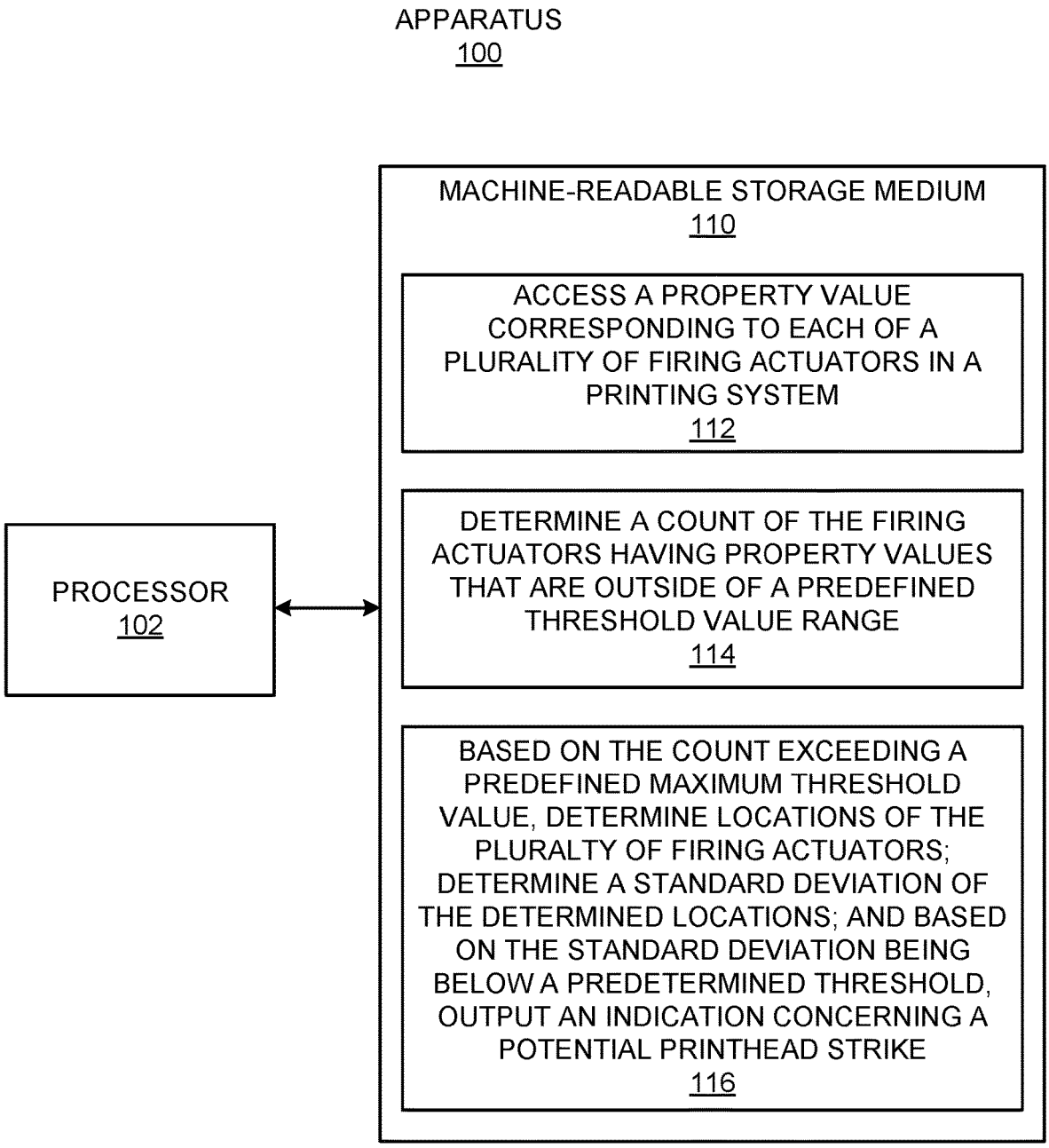
FIG. 1 shows a block diagram of an example apparatus that may determine whether a potential printhead strike has occurred on a printhead.

For simplicity and illustrative purposes, the present disclosure may be described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" may be intended to denote at least one of a particular element. As used herein, the term "includes" means includes but not limited to, the term "including" means including but not limited to. The term "based on" means based at least in part on.

In many types of printing systems, arrays of firing actuators are typically disposed on a printhead (e.g., a printhead die) face along an array direction and the face of the printhead containing the array of firing actuators is positioned near the recording medium in order to provide improved print quality. For instance, close positioning of the printhead face to the recording medium may keep the printed droplets of printing material close to their intended locations. Generally, the position of the recording medium relative to the printhead face may be fairly well controlled. However, there may arise situations in which the recording medium may have a wrinkle or debris may be on the surface of the recording medium. In such situations, the close proximity of the printhead face to the position of the recording medium may result in the recording medium or debris striking the face of the printhead as the recording medium is moved past the printhead and/or as the printhead is moved past the recording medium.

In some instances, for instance, in printhead faces that are made of a fragile or brittle material, such strikes may cause damage to the printhead faces, which may require replacement of the printhead. For instance, as the printhead and/or the recording medium may be moving at a relatively fast pace, the impact (or printhead strike) may cause the printhead (or printhead face) to be damaged, e.g., may crack a section of the printhead. In addition, the nozzles and/or the firing actuators located in the damaged section of the printhead may not operate properly, which may result in printing defects, such as banding or streaking, to appear on the recording medium.

Disclosed herein are apparatuses and methods for determining whether a potential printhead strike has occurred on a printhead or on multiple printheads in a printing system. Particularly, the apparatuses may identify abnormally behaving firing actuators in a printhead (or in multiple printheads) and the locations of the abnormally behaving firing actuators. The abnormally behaving firing actuators may include firing actuators that have property values (resistance values, capacitance values, or the like) that are outside of a predefined threshold range.

In some examples, a standard deviation of the identified locations of the abnormally behaving firing actuators may be determined and based on the determined standard deviation below a predetermined threshold, an indication concerning a potential printhead strike may be outputted. In other examples, a location pattern of the identified locations of the abnormally behaving firing actuators may be determined and a determination may be made as to whether the location pattern meets a predefined location pattern that is indicative of a printhead strike. In addition, based on a determination that the determined location pattern meets the predefined location pattern, e.g., matches the predefined location pattern within a certain degree of deviation, an indication concerning the potential printhead strike may be outputted. The indication concerning the potential printhead strike may be a notification of the potential printhead strike, an instruction for an operator to stop a printing operation, an instruction that stops the printing operation, or the like.

In the apparatuses and methods disclosed herein, the property values of the firing actuators may be determined (or equivalently, measured) through use of a property value detector. The property value detector may be part of the printing system and thus, in one regard, the apparatuses and methods disclosed herein may utilize existing hardware components in determining whether a potential printhead strike has occurred on a printhead or on multiple printheads in a printing system. In addition, the apparatuses and methods disclosed herein may determine whether a potential printhead strike has occurred without applying printing material on a recording medium and may thus reduce wasted printing material and recording medium to make this determination.

A technical issue associated with determining whether a printhead strike has occurred is that normally, printing material is printed in a particular test pattern on a recording medium to test the firing actuators and an image of the test pattern is captured and processed to determine whether there are any defective firing actuators. This process not only wastes consumables, but the results of this process may merely identify defective firing actuators without actually determining whether a printhead strike has potentially occurred. In addition, the apparatuses and methods disclosed herein may inform an operator and/or may automatically shutdown a printing operation when a potential printhead strike is determined to have occurred, which may also reduce recording mediums having defects from being generated.

A technical improvement provided by the apparatuses and methods disclosed herein may be that potential printhead strikes may be determined accurately without wasting consumables. In addition, the potential printhead strikes may be determined without significantly disrupting printing operations, e.g., the determinations may be made quickly between pauses in printing operations.

Figure 2:
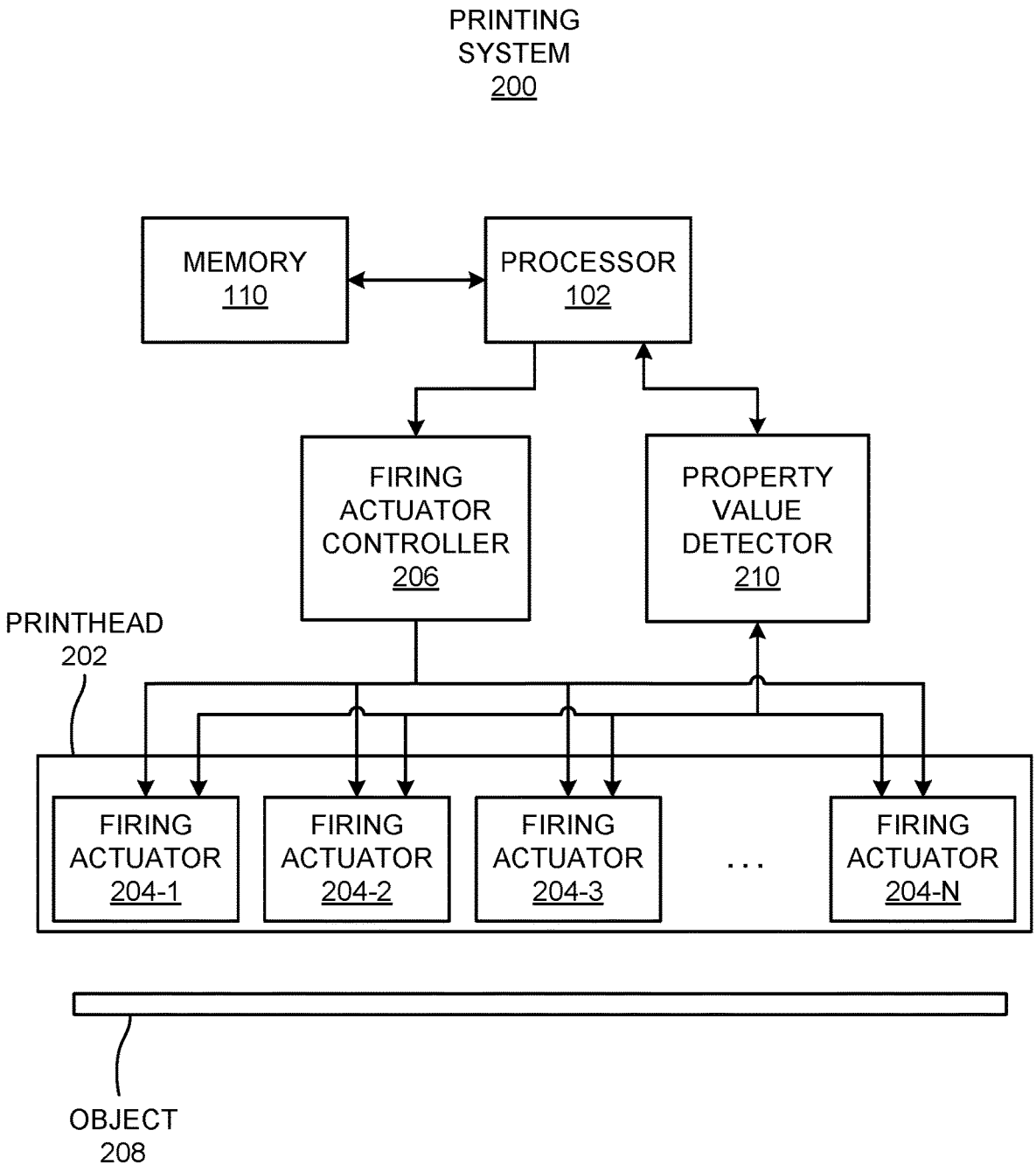
FIG. 2 depicts a block diagram of an example printing system having components that the apparatus depicted in FIG. 1 may control to determine whether a potential printhead strike has occurred on a printhead.

Reference is first made to FIGS. 1 and 2. FIG. 1 shows a block diagram of an example apparatus 100 that may determine whether a potential printhead strike has occurred on a printhead. FIG. 2 depicts a block diagram of an example printing system 200 having components that the apparatus 100 depicted in FIG. 1 may control to determine whether a potential printhead strike has occurred on a printhead. It should be understood that the example apparatus 100 depicted in FIG. 1 and the printing system 200 depicted in FIG. 2 may include additional features and that some of the features described herein may be removed and/or modified without departing from either of the scopes of the apparatus 100 or the printing system 200.

The apparatus 100 may be a computing device, a server, a laptop computer, or the like. The apparatus 100 may alternatively be part of a control system of the printing system 200. As shown in FIGS. 1 and 2, the apparatus 100 may include a processor 102 (which may also be referenced herein as a controller 102) that may control operations of the apparatus 100 and the printing system 200. The processor 102 may be a semiconductor-based microprocessor, a central processing unit (CPU), an application specific integrated circuit (ASIC), a field-programmable gate array (FPGA), and/or other suitable hardware device. Although the apparatus 100 and the printing system 200 are depicted as including a single processor 102, it should be understood that the apparatus 100 and/or the printing system 200 may include multiple processors, multiple cores, or the like, without departing from a scope of the apparatus 100 and/or the printing system 200.

The apparatus 100 and the printing system 200 may also include a machine-readable storage medium 110 that may have stored thereon machine readable instructions 112-118 (which may also be termed computer readable instructions) that the processor 102 may execute. The machine-readable storage medium 110 may be an electronic, magnetic, optical, or other physical storage device that contains or stores executable instructions. The machine-readable storage medium 110 may be, for example, Random Access memory (RAM), an Electrically Erasable Programmable Read-Only Memory (EEPROM), a storage device, an optical disc, and the like. The machine-readable storage medium 110 may be a non-transitory machine-readable storage medium, where the term "non-transitory" does not encompass transitory propagating signals.

The printing system 200 may be one of a web press printing system, three-dimensional printing system, a desktop printing system, a sheet fed printing system, a direct to corrugate printing system, a direct to object printing system, a multifunction printing system, or the like. As shown in FIG. 2, the printing system 200 may include a printhead 202 that may include a plurality of firing actuators 204-1 to 204-N, in which the variable "N" is a value greater than one. For instance, the printhead 202 may include hundreds or thousands of firing actuators 204-1 to 204-N per square inch. The printing system 200 may include numerous rows of printheads 202 to provide redundancy as well as to provide multiple colors of printing material onto the object 208.

According to examples, the firing actuators 204-1 to 204-N may include electrically resistive elements that may become heated as a current is applied through the electrically resistive elements. In addition, as the electrically resistive elements are heated, printing material, e.g., ink, inside of respective firing chambers may be vaporized, which may cause a portion of the ink in the firing chambers to be expelled through respective nozzles in fluid communication with the firing chambers. In these examples, the firing actuators 204-1 to 204-N may be thermal inkjet (TIJ) resistors.

In other examples, the firing actuators 204-1 to 204-N may include piezoelectric elements that may flex as a current is applied through the piezoelectric elements. Flexure of the piezoelectric elements may force printing material, e.g., ink, inside of respective firing chambers to be expelled from the firing chambers expelled through respective nozzles in fluid communication with the firing chambers. In still other examples, the firing actuators 204-1 to 204-N may include other types of element that may controllably be actuated as a current is applied through the firing actuators 204-1 to 204-N.

As also shown in FIG. 2, the printing system 200 may include a firing actuator controller 206 that may control the selective delivery of a current to the firing actuators 204-1 to 204-N. The firing actuator controller 206 may be a semiconductor-based microprocessor, a central processing unit (CPU), an application specific integrated circuit (ASIC), a field-programmable gate array (FPGA), and/or other suitable hardware device. In some examples, the processor 102 made control the firing actuator controller 206 through indication of instructions to print an intended image on an object 208. In other examples, the firing actuator controller 206 and the processor 102 may be a single component, e.g., the processor 102 may perform the functions of the firing actuator controller 206 discussed herein.

Generally speaking, the firing actuator controller 206 may selectively control the firing actuators 204-1 to 204-N to apply printing material onto an object 208 (e.g., a sheet of media, a layer of build material used for 3D printing, an product, a 3D object, or the like) in a particular pattern or order to cause a particular image to be formed on the object 208. That is, the firing actuator controller 206 may selectively control the firing actuators 204-1 to 204-N to apply printing material onto selected areas of the object 208 at selected times to cause the particular image to be formed. In addition, as the printing material is expelled from respective firing chambers, the printing material is replenished into the respective firing chambers to thus enable the printing material to be continuously applied from the firing chambers. In some examples, the printhead 202 may apply the same type of printing materials (e.g., color, composition, etc.) through actuation of each of the firing actuators 204-1 and 204-N. In other examples, the printhead 202 may apply different types of printing materials (e.g., printing materials having different colors, different compositions, etc.) through actuation of the firing actuators 204-1 to 204-N.

In some examples, the printhead 202 may extend the width of the object 208 and the object 208 may be moved past the printhead 202 and/or vice versa in a down-web or down-object direction. Alternatively, multiple printheads 202 may be positioned along the width of the object 208, i.e., perpendicular to the down-object direction such that the printheads 202 may extend across the width of the object 208. In these examples, the printheads 202 may be staggered with respect to each other such that there may be overlap among some of the nozzles in multiple ones of the printheads 202 along the down-object direction. The down-web or down-object direction may be represented in FIG. 2 as extending into the figure.

In other examples, the printhead 202 may extend a distance that is shorter than the width of the object 208. In these examples, the printhead 202 and/or the object 208 may be moved in multiple X-Y directions with respect to each other such that the particular image may be printed onto multiple locations on the object 208. In any of these examples, the processor 102 may control other actuators in the printing system 200 such as an actuator for moving the printhead 202, an actuator for moving the object 208, an actuator for controlling a drying component, an actuator for controlling a cooling component, and/or the like.

In any of the examples, the printhead 202 may be positioned at a relatively short distance from the object 208 to facilitate accurate deposition of printing material onto desired locations on the object 208. The relatively short distance may be sufficiently short such that the printhead 202 may be impacted by debris on the object 208, build material forming the object 208, wrinkles in the object 208, and/or the like impacting the bottom of the printhead 202 as the object 208 is moved past the printhead 202 and/or as the printhead 202 is moved past the object 208. In certain instances, the impact (or printhead strike) may cause the printhead 202 to be damaged, e.g., may crack a section of the printhead 202. In addition, the nozzles and/or the firing actuators 204-1 to 204-N located in the damaged section of the printhead 202 may not operate properly, which may result in printing defects, such as banding or streaking, to appear on the object 208. As discussed herein, the processor 102 may identify abnormally behaving firing actuators 204-1 to 204-N in the printhead 202 (or in multiple printheads 202) and based on the locations and/or pattern formed by the abnormally behaving firing actuators 204-1 to 204-N, determine whether a potential printhead strike has occurred. If so, the processor 102 may output an indication of the potential printhead strike to inform an operator and/or may stop a printing operation.

As further shown in FIG. 2, the printing system 200 may include a property value detector 210 (which may also be referenced herein as a sensor 210) to detect property values respectively corresponding to the plurality of firing actuators 204-1 to 204-N. The property value detector 210 may include a sensor or other measurement device that may detect or measure the property values corresponding to the plurality of firing actuators 204-1 to 204-N. Although a single property value detector 210 is depicted in FIG. 2 as being in communication with each of the firing actuators 204-1 to 204-N, the printing system 200 may instead include a plurality of property value detectors 210, in which each of the plurality of property value detectors 210 may detect a property value of a respective firing actuator 204-1 to 204-N without departing from the scope of the printing system 200.

The detected property values may include one of resistance values of the firing actuators 204-1 to 204-N (thermal inkjet resistors), capacitance values of the firing actuators 204-1 to 204-N (piezoelectric elements), or other values of the firing actuators 204-1 to 204-N. In any of these examples, the property value detector 210 may communicate detected property values to the processor 102. In addition, the processor 102 may use the detected property values to determine whether the firing actuators 204-1 to 204-N are functioning properly or if there may be potential issues with the firing actuators 204-1 to 204-N. Particularly, and as discussed in greater detail herein, the processor 102 may determine whether a potential printhead strike has occurred based on the detected property values and the locations at which abnormally behaving firing actuators 204-1 to 204-N are located.

The processor 102 may cause a testing operation to be performed following an initial startup of the printing system 200, prior to and/or after a printing operation, or the like. In some examples, the processor 102 may cause the testing operation to be performed at any time other than on a printing operation is being performed. During a testing operation, the processor 102 may cause, e.g., through the firing actuator controller 206, a testing current to be applied across a selected one of the firing actuator 204-1. The testing current may be relatively lower than a firing current and may not be of sufficient strength to cause the firing actuator 204-1 to cause a droplet of printing material to be ejected from a firing chamber of the firing actuator 204-1. In this regard, the testing current may be lower than a firing current used to cause the firing actuator 204-1 to eject a droplet of printing material.

As the testing current is applied across the firing actuator 204-1, the property value detector 210 may measure the property value of the firing actuator 204-1. For instance, the property value detector 210 may measure a resistance level across the firing actuator 204-1, e.g., may measure a drop in voltage across the firing actuator 204-1. As another example, the property value detector 210 may measure a capacitance level of the firing actuator 204-1. In any regard, the property value detector 210 may communicate the measured property value to the processor 102. The processor 102 may compare the measured property value to a predefined property value range to determine whether the measured property value is outside of the predefined property value range. The predefined property value range may be a range of property values that may have previously been determined as corresponding to property values of normally functioning firing actuators 204-1 to 204-N.

The above-defined process may be repeated for each of the remaining firing actuators 204-2 to 204-N to identify the property values for the remaining firing actuators 204-2 to 204-N. In addition, the identified property values may be stored in a data store (not shown). Although the printing system 200 is depicted as including a single printhead 202, it should be understood that the printing system 200 may include any number of printheads 202 and that the printheads 202 may be arranged in any suitable configuration with respect to each other. For instance, the printing system 200 may include a first printhead 202 to print a first color (e.g., cyan), a second printhead 202 to print a second color (e.g., yellow), a third printhead 202 to print a third color (e.g., magenta), a fourth printhead 202 to print a fourth color (e.g., black), etc. The printing system 200 may also include multiple ones of these printheads 202 aligned, for instance, in the down-web or down-object direction, for instance, as configured in a web-press printing system.

According to examples, the processor 102 may be part of circuitry to capture data representing the property values of each firing actuator 204-1 to 204-N within a printhead 202 (or in multiple printheads 202). The data may be captured by a process programmed into the circuitry FPGA, which may set the printhead 202 into a test mode that may allow a constant current source to be connected to the firing actuator driving voltage to provide a linear relationship between firing property value and voltage across the firing actuators 204-1 to 204-N. A constant current source and analog to digital converter (ADC) may be present on the circuit and may be used to capture the voltage across the firing actuators 204-1 to 204-N, as each firing resistor 204-1 to 204-N on the printhead 202 is sequentially and individually connected to the current source by the FPGA logic circuitry. The processor 102 may process the captured data, which may convert the ADC captured voltage to the property value, e.g., resistance, and may assign a nozzle number to the converted value that correlates the result to an affiliated nozzle on the printhead 202. The processor 102 may report the data to a print engine controller (PEC) via a parallel or serial bus interface used to communicate between the PEC and the circuitry. The process may be performed in parallel with each printhead 202 in the printing system 300 so that multiple printheads 202 may undergo the process simultaneously.

With reference back to FIG. 1, the processor 102 may fetch, decode, and execute the instructions 112 to access a property value corresponding to each of the firing actuators 204-1 to 204-N in the printing system 200. For instance, the processor 102 may access the property values of the firing actuators 204-1 to 204-N stored in a data store. In addition, the processor 102 may access the property values of each of the firing actuators 204-1 to 204-N in each of the printheads 202 in the printing system 200, the firing actuators 204-1 to 204-N in some of the printheads 202 in the printing system 200, the firing actuators 204-1 to 204-N in one of the printheads 202 in the printing system 200, a subset of the firing actuators 204-1 to 204-N in one of the printheads 202 in the printing system 200, or the like.

The processor 102 may fetch, decode, and execute the instructions 114 to determine a count of the firing actuators 204-1 to 204-N in the printing system 200 that are outside of a predefined threshold value range. That is, the processor 102 may compare the property values of the firing actuators 204-1 to 204-N with the predefined property value range to identify which of the firing actuators 204-1 to 204-N, if any, have property values that are outside of the predefined property value range. The processor 102 may also determine a count of the firing actuators 204-1 to 204-N that have property values that are outside of the predefined property value range. In addition, the processor 102 may determine whether the determined count of the predefined property value range exceeds a predefined maximum threshold value. The predefined maximum threshold value may correspond to a count that is indicative of a potential printhead strike. The predefined maximum threshold value may, in other examples, be a range of values.

According to examples, the predefined maximum threshold value may be determined from empirical data accumulated through testing, analysis of various printhead strikes, and/or through computational analysis. In other examples, the predefined maximum threshold value may be determined from testing and/or analysis of other types of conditions that may result in the firing actuators 204-1 to 204-N having property values that are outside of the predefined property value range. For instance, a small number of firing actuators, e.g., less than a predefined number, may be indicative of a condition other than a potential printhead strike. Likewise, a large number of firing actuators, e.g., more than a predefined number, all of the firing actuators in a printhead 202, etc., may be indicative of a condition affecting the entire printhead 202 and thus, a larger issue than a potential printhead strike. In other examples, a user may define the predefined maximum threshold value based on, for instance, a desired sensitivity level. Thus, for instance, the predefined maximum threshold level may be set to a lower value in instances in which a sensitivity level of the detection of potential printhead strikes is set to be higher. Likewise, the predefined maximum threshold value may be set to a higher value in instances in which a sensitivity level of the detection of potential printhead strikes is set to be lower.

The processor 102 may fetch, decode, and execute the instructions 116 to, based on the count exceeding the predefined maximum threshold value, determine locations of the plurality of the firing actuators 204-1 to 204-N having property values that are outside of the predefined threshold value range. For instance, the processor 102 may access a database or other data that indicates the locations of the firing actuators 204-1 to 204-N. The locations may identify, for instance, the printhead(s) 202 on which the firing actuators 204-1 to 204-N are located, the locations of the firing actuators 204-1 to 204-N with respect to each other, and/or the like.

The processor 102 may also determine a standard deviation of the determined locations. That is, for instance, the processor 102 may determine the amount of variation or dispersion of the determined locations with respect to each other. In other words, the processor 102 may determine whether the determined locations of the firing actuators 204-1 to 204-N having property values that are outside of the predefined threshold value range are near each other or are dispersed with respect to each other. In addition, based on the determined standard deviation being below a predetermined threshold, the processor 102 may output an indication concerning a potential printhead strike. That is, the processor 102 may determine that a potential printhead strike may have occurred based on the determined locations being near each other or that a potential printhead strike may not have occurred based on the determined locations being dispersed with respect to each other. For instance, the processor 102 may determine that a potential printhead strike has not occurred based on the determined standard deviation of the determined locations being above the predetermined threshold.

Based on a determination that a potential printhead strike may have occurred, the processor 102 may output the indication concerning the potential printhead strike. The indication may be a message on a display of the printing system 200 and/or on a computing device, an audible alarm, a message sent to a user's device, etc. The indication may also be an indication to stop a printing operation and to investigate the condition of the printhead 202 or printheads 202. The indication may additionally or alternatively include an instruction for the printing system 200 to stop a current printing operation, e.g., may stop sending instructions to the firing actuator controller 206 to activate the firing actuators 204-1 to 204-N, may stop a motor from moving the object 208, etc.

According to examples, the predetermined threshold may correspond to a standard deviation that is indicative of a potential printhead strike. The predefined threshold may be determined through testing and/or analysis of various printhead strikes. In other examples, a user may define the predefined threshold based on, for instance, a desired sensitivity level. Thus, for instance, the predefined threshold may be set to a lower value in instances in which a sensitivity level of the detection of potential printhead strikes is set to be higher. Likewise, the predefined threshold may be set to a higher value in instances in which a sensitivity level of the detection of potential printhead strikes is set to be lower.

Instead of the machine-readable storage medium 110, the apparatus 100 may include hardware logic blocks that may perform functions similar to the instructions 112-116. In other examples, the apparatus 100 may include a combination of instructions and hardware logic blocks to implement or execute functions corresponding to the instructions 112-116. In any of these examples, the processor 102 may implement the hardware logic blocks and/or execute the instructions 112-116. As discussed herein, the apparatus 100 may also include additional instructions and/or hardware logic blocks such that the processor 102 may execute operations in addition to or in place of those discussed above with respect to FIG. 1.

Figure 3:
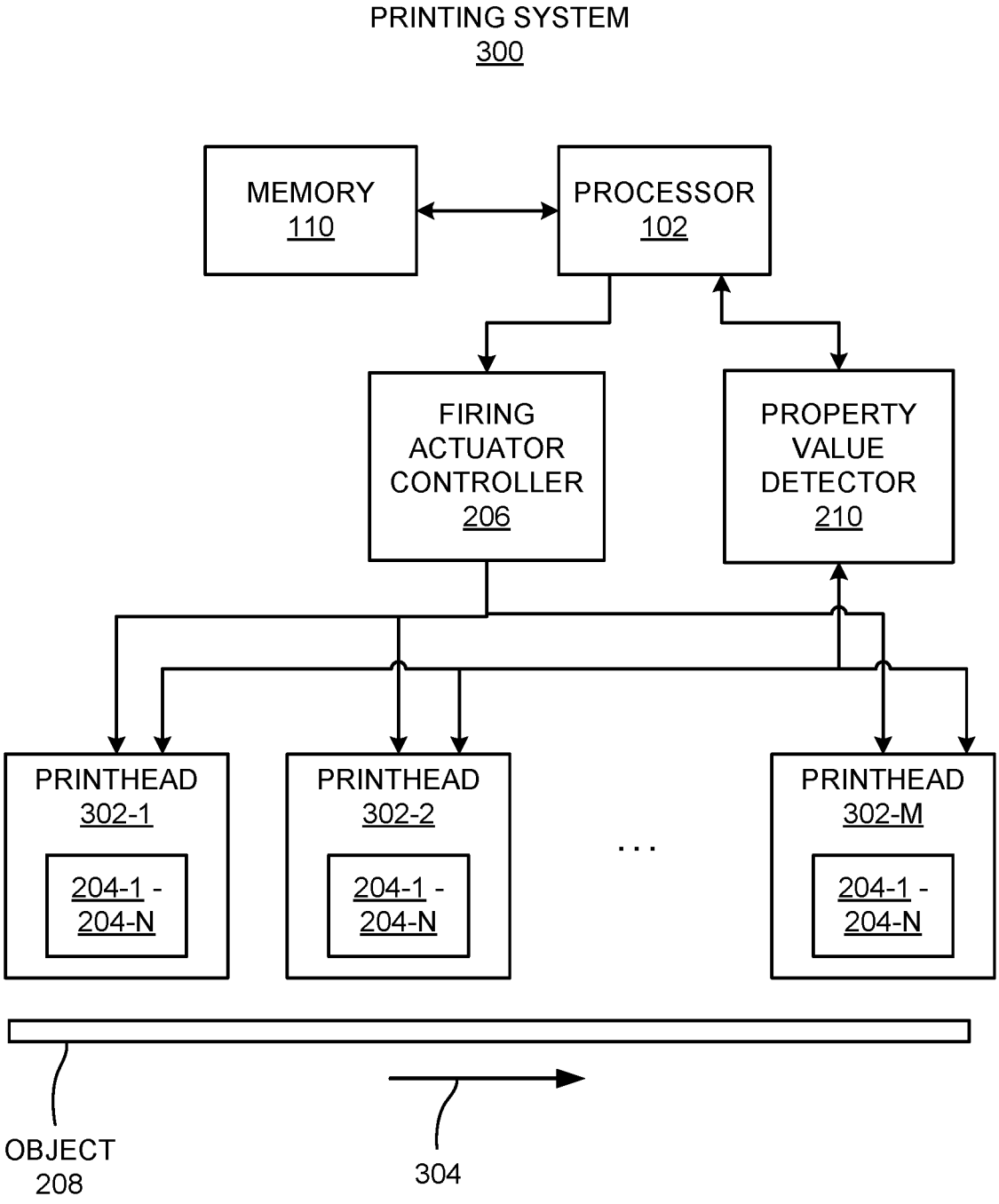
FIG. 3 depicts a block diagram of an example printing system having components that the apparatus depicted in FIG. 1 may control to determine whether a potential printhead strike has occurred on a printhead or on multiple printheads.

With reference now to FIG. 3, there is shown a block diagram of an example printing system 300 having components that the apparatus 100 depicted in FIG. 1 may control to determine whether a potential printhead strike has occurred on a printhead or on multiple printheads 302-1 to 302-M. It should be understood that the example printing system 300 depicted in FIG. 3 may include additional features and that some of the features described herein may be removed and/or modified without departing from the scope of the printing system 300.

The printing system 300 may include the same elements as the printing system 200 depicted in FIG. 2. In this regard, the printing system 300 may include the processor 102, the memory 110, the firing actuator controller 206, and the property value detector 210 discussed above with respect to FIG. 2. The printing system 300 may also include a plurality of printheads 302-1 to 302-M, in which the variable M may represent a value greater than one. Each of the printheads 302-1 to 302-M may include a respective set of a plurality of firing actuators 204-1 to 204-N. In this regard, the firing actuator controller 206 may selectively control the firing actuators 204-1 to 204-N in each of the printheads 302-1 to 302-M to apply printing material in a particular pattern to print a desired image on the object 208. Although the multiple printheads 302-1 to 302-M are depicted as sharing the same firing actuator controller 206, it should be understood that each of the printheads 302-1 to 302-M may have a respective firing actuator controller 206. In addition or alternatively, although the multiple printheads 302-1 to 302-M are depicted as sharing the same property value detector 210, it should be understood that each of the printheads 302-1 to 302-M may have a respective property value detector 210.

As shown, the printheads 302-1 to 302-M may be positioned with respect to each other along a down-object direction as indicated by the arrow 304. Thus, for instance, the object 208 may sequentially be moved past the first printhead 302-1, the second printhead 302-2, and so forth. In other examples, the printheads 302-1 to 302-M may be moved past the object 208 in the direction denoted by the arrow 304. In any regard, at least some of the printheads 302-1 to 302-M may be staggered with respect to other ones of the printheads 302-1 to 302-M in the direction perpendicular to the arrow 304. In addition, some of the printheads 302-1 to 302-M may at least partially overlap with each other in the direction perpendicular to the arrow 304.

According to examples, a piece of debris or a defect in the object 208 may contact multiple ones of the printheads 302-1 to 302-M as the object 208 is moved past the printheads 302-1 to 302-M or the printheads 302-1 to 302-M are moved past the object 208. In this regard, the debris or other defect may contact the printheads 302-1 to 302-M in a line extending in the direction indicated by the arrow 304. That is, for instance, the debris or other defect may contact locations of the printheads 302-1 to 302-M that may extend along a line in the direction denoted by the arrow 304. In this regard, the processor 102 may determine that a printhead strike has likely occurred in instances in which the firing actuators 204-1 to 204-N in multiple ones of the printheads 302-1 to 302-M located along a line extending in the direction denoted by the arrow 304 are determined to be operating abnormally, e.g., have property values that are outside of the predefined threshold value range.

Figure 4:
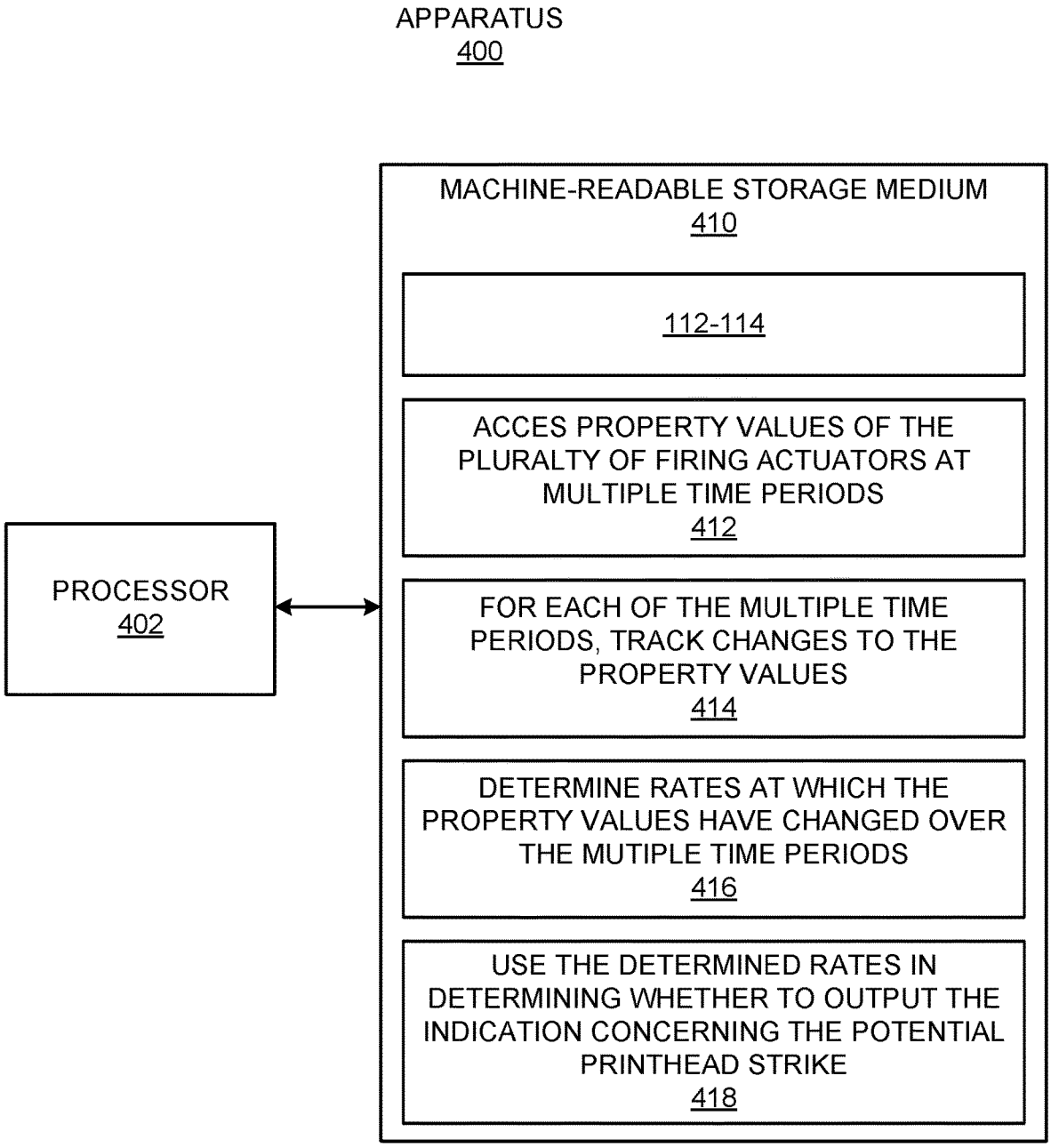
FIG. 4 shows a block diagram of another example apparatus that may determine whether a potential printhead strike has occurred on a printhead.

Turning now to FIG. 4, there is shown a block diagram of another example apparatus 400 that may determine whether a potential printhead strike has occurred on a printhead 202. It should be understood that the example apparatus 400 depicted in FIG. 4 may include additional features and that some of the features described herein may be removed and/or modified without departing from the scope of the apparatus 400.

The apparatus 400 may be similar to the apparatus 100 depicted in FIG. 1. In addition, the apparatus 400 may include a processor 402 and a machine-readable storage medium 410, which may be equivalent to the processor 102 and the machine-readable storage medium 110 depicted in FIG. 1. In addition to the instructions 112-116, the machine-readable storage medium 410 may include instructions 412-418.

The processor 102 may fetch, decode, and execute the instructions 412 to access property values of the plurality of the firing actuators 204-1 to 204-N at multiple time periods. For instance, the processor 102 may access property values of the firing actuators 204-1 to 204-N that have been determined at multiple instances over a predetermined period, e.g., over a day, over a week, etc.

The processor 102 may fetch, decode, and execute the instructions 414 to, for each of the multiple time periods, track changes to the property values of the firing actuators 204-1 to 204-N. In other words, the processor 102 may determine if and by how much the property values of the firing actuators 204-1 to 204-N have changed over the multiple time periods.

The processor 102 may fetch, decode, and execute the instructions 416 to determine rates at which the property values have changed over the multiple time periods. For instance, the processor 102 may determine whether the property values of some of the firing actuators 204-1 to 204-N have changed at a faster or slower rate as compared with each other. In addition, the processor 102 may determine identify the firing actuators 204-1 to 204-N having property values that have changed at a faster rate than the other firing actuators 204-1 to 204-N, e.g., beyond a standard deviation.

The processor 102 may fetch, decode, and execute the instructions 418 to use the determined rates in determining whether to output the indication concerning the potential printhead strike. In other words, the processor 102 may use the determined rates as a factor in determining whether a printhead strike has likely occurred. Particularly, for instance, the processor 102 may determine that there is a greater likelihood that a printhead strike has occurred based on a determination that the rates of change are relatively high, which may be indicative of changes caused by an impact. Likewise, the processor 102 may determine that there is a greater likelihood that a printhead strike has not occurred based on a determination that the rates of change are relatively low, which may be indicative of another issue that may have caused the abnormal property values. In this regard, for example, in instances in which the processor 102 initially determines that a printhead strike has likely occurred but the property values of the potentially affected firing actuators 204-1 to 204-N changed gradually over time, the processor 102 may determine that a printhead strike likely has not occurred and may not output the indication of the potential printhead strike. Instead, for instance, the processor 102 may output another indication regarding the abnormal property values.

Figure 5:
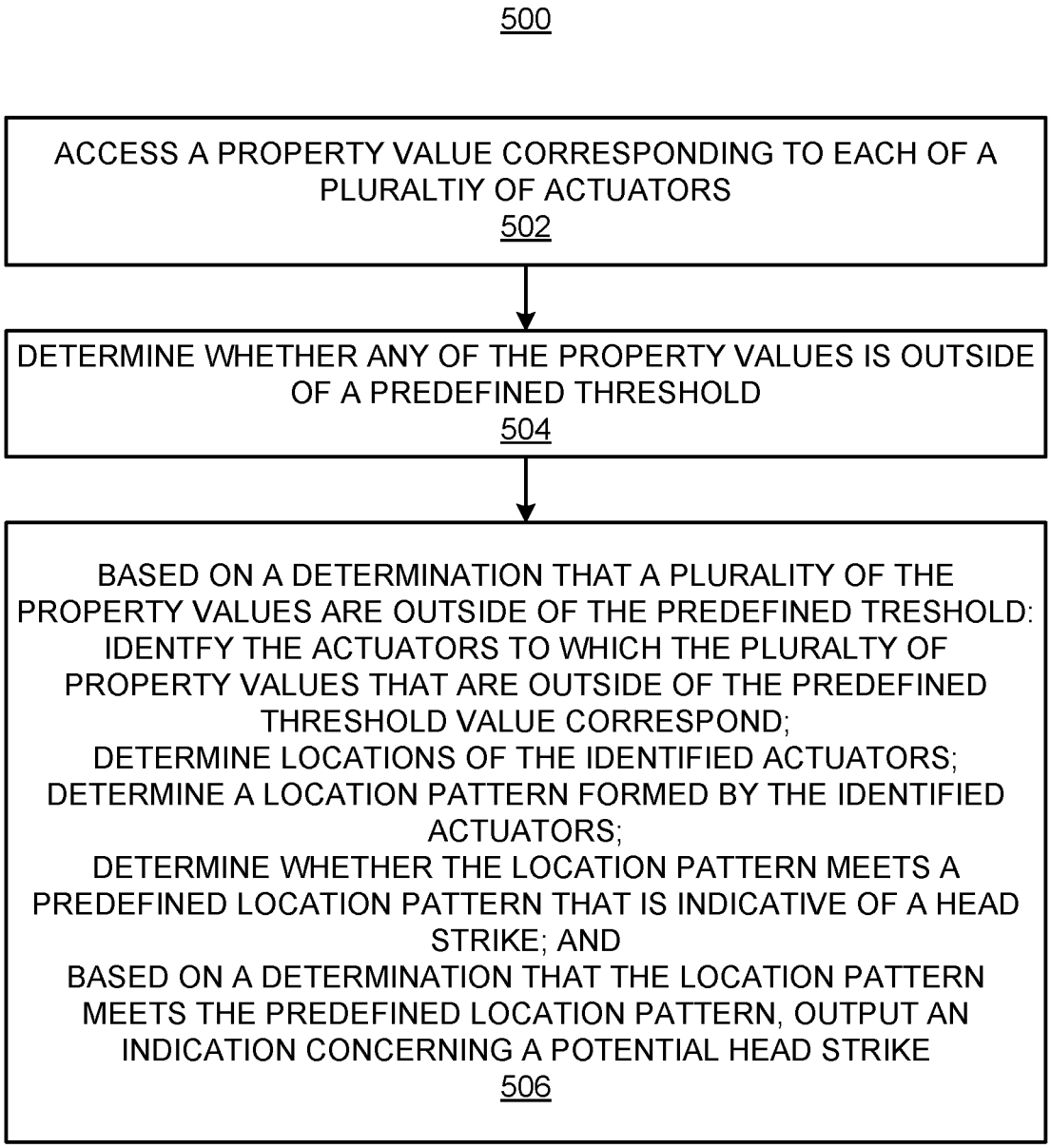
FIG. 5 depicts a flow diagram of an example method for determining whether to output an indication concerning a potential head strike.
Figure 6:
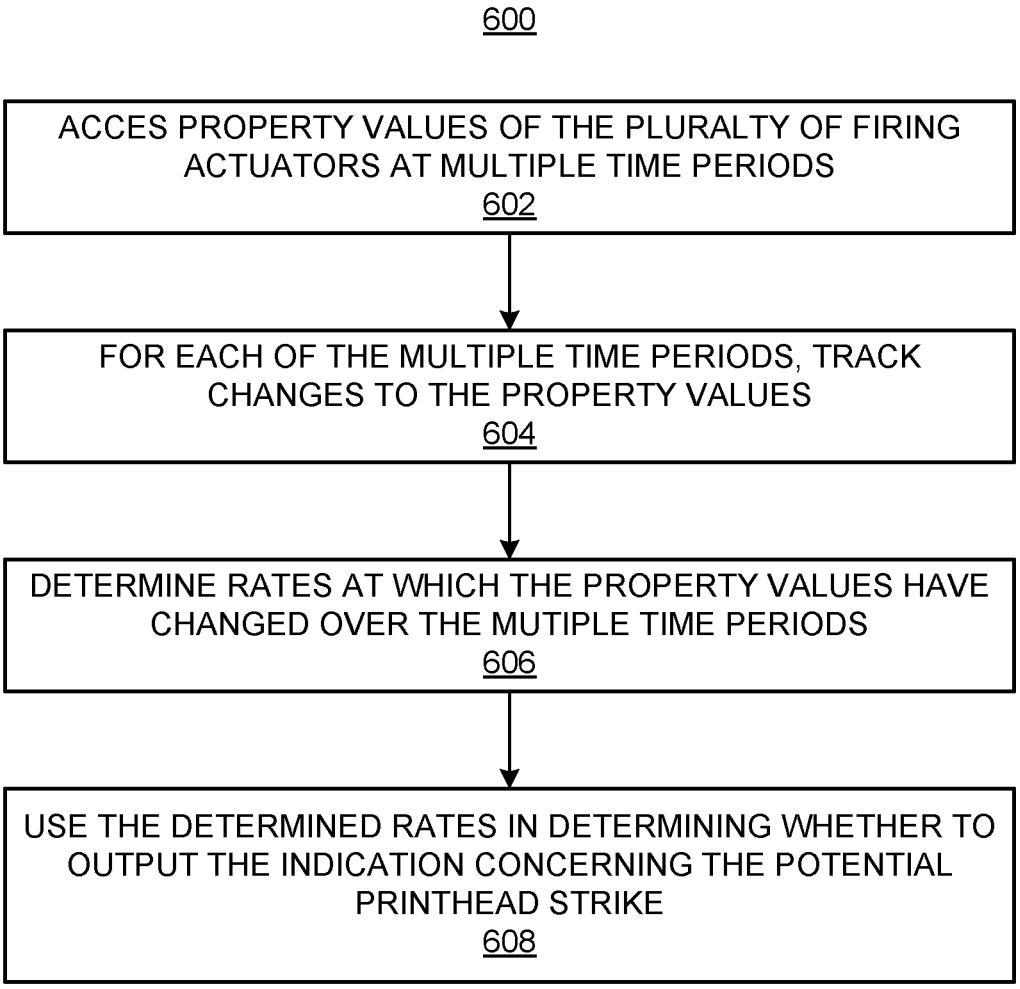
FIG. 6 depicts a flow diagram of an example method for determining rates at which property values of the actuators have changed over time and using the determined rates as a factor in determining whether a printhead strike has likely occurred.
Figure 7:
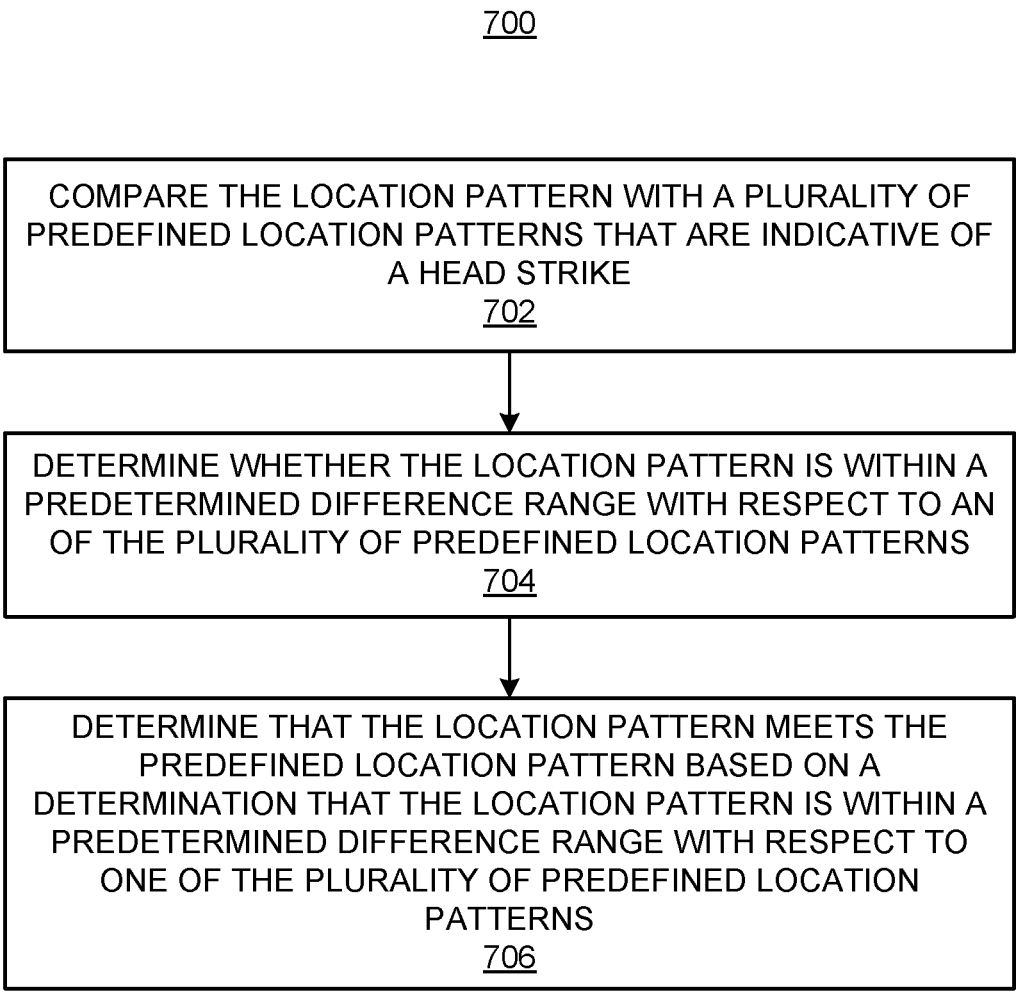
FIG. 7 depicts a flow diagram of an example method for determining whether the location pattern meets the predefined location pattern as discussed in FIG. 5.

Various manners in which the apparatuses 100, 400 may operate are discussed in greater detail with respect to the methods 500-700 respectively depicted in FIGS. 5-7. Particularly, FIG. 5 depicts a flow diagram of an example method 500 for determining whether to output an indication concerning a potential head strike. FIG. 6 depicts a flow diagram of an example method 600 for determining rates at which property values of the actuators 204-1 to 204-N have changed over time and using the determined rates as a factor in determining whether a printhead strike has likely occurred. FIG. 7 depicts a flow diagram of an example method 700 for determining whether the location pattern meets the predefined location pattern as discussed in FIG. 5. It should be understood that the methods 500-700 may include additional operations and that some of the operations described therein may be removed and/or modified without departing from the scopes of the methods 500-700. The descriptions of the methods 500-700 are made with reference to the features depicted in FIGS. 1-4 for purposes of illustration.

With reference first to FIG. 5, at block 502, the processor 102, 402 may access a property value corresponding to each of a plurality of actuators (equivalently recited herein as firing actuators 204-1 to 204-N). For instance, the processor 102, 402 may access the property value corresponding to each of a plurality of actuators of multiple printheads 302-1 to 302-M. In addition, the property values may have been determined and stored in a data store and the processor 102, 402 may access the determined property values from the data store.

At block 504, the processor 102, 402 may determine whether any of the property values is outside of a predefined threshold value. That is, for instance, the processor 102, 402 may determine whether any of the property values is above an upper predefined threshold value and/or is below a lower predefined threshold value. The processor 102, 402 may compare the property values of the actuators 204-1 to 204-N with the predefined property value to identify which of the actuators 204-1 to 204-N, if any, have property values that are above the upper the predefined property value and/or below the lower predefined property value. In any regard, the property value may be a property value below which (or above which) may have previously been determined as corresponding to property values of normally functioning actuators 204-1 to 204-N.

At block 506, the processor 102, 402 may, based on a determination that a plurality of the property values are outside of the predefined threshold value, identify the actuators 204-1 to 204-N to which the plurality of property values that are outside of the predefined threshold value correspond. The processor 102, 402 may identify the actuators 204-1 to 204-N from data stored in the data store. In addition, the processor 102, 402 may determine locations of the identified actuators 204-1 to 204-N, for instance, from a mapping of the actuators 204-1 to 204-N and their respective locations. The processor 102, 402 may also determine a location pattern formed by the identified actuators 204-1 to 204-N. The identified actuators 204-1 to 204-N may be in one printhead 202 or in multiple printheads 302-1 to 302-M and thus, the location pattern may be of locations of actuators 204-1 to 204-N in one or multiple printheads 302-1 to 302-M.

Moreover, the processor 102, 402 may determine whether the determined location pattern meets a predefined location pattern that is indicative of a head strike (which may be equivalent to a printhead strike). By way of example, the predefined location pattern may include a pattern that extends across actuators 204-1 to 204-N in a plurality of the multiple printheads 302-1 to 302-M that are arranged along a down-web or down-object direction with respect to each other. For instance, the predefined location pattern may include actuators that are in a line in the down-web or down-object direction. In any regard, based on a determination that the location pattern meets the predefined location pattern, the processor 102, 402 may output an indication concerning a potential head strike. For instance, the indication concerning the potential printhead strike may include at least one of a notification of the potential printhead strike, output an instruction to instruct an operator to stop a printing operation, output an instruction that stops the printing operation, or the like.

Turning now to the example method 600 depicted in FIG. 6, at block 602, the processor 102, 402 may access property values of the plurality of the actuators 204-1 to 204-N at multiple time periods. For instance, the processor 102 may access property values of the actuators 204-1 to 204-N that have been determined at multiple instances over a predetermined period, e.g., over a day, over a week, etc. At block 604, the processor 102, 402 may, for each of the multiple time periods, track changes to the property values of the actuators 204-1 to 204-N. In other words, the processor 102, 402 may determine if and by how much the property values of the actuators 204-1 to 204-N have changed over the multiple time periods.

At block 606, the processor 102, 402 may determine rates at which the property values have changed over the multiple time periods. In addition, at block 608, the processor 102, 402 may use the determined rates in determining whether to output the indication concerning the potential printhead strike. In other words, the processor 102, 402 may use the determined rates as a factor in determining whether a printhead strike has likely occurred as discussed above with respect to FIG. 4.

With reference now to the example method 700 depicted in FIG. 7, at block 702, the processor 102, 402 may compare the location pattern with a plurality of predefined location patterns that are indicative of a head strike. The predefined location patterns may have been identified through empirical data from testing, simulations, user-defined, or the like. In addition, at block 704, the processor 102, 402 may determine whether the location pattern is within a predetermined difference range with respect to any of the plurality of predefined location patterns. The predetermined difference range may be user-defined, may be based on empirical data from testing, may be based on simulations, or the like. Moreover, at block 706, the processor 102, 402 may determine that the location pattern meets the predefined location pattern based on a determination that the location pattern is within a predetermined difference range with respect to one of the plurality of predefined location patterns.

Some or all of the operations set forth in the methods 500-700 may be contained as utilities, programs, or subprograms, in any desired computer accessible medium. In addition, the methods 500-700 may be embodied by computer programs, which may exist in a variety of forms. For example, some operations of the methods 500-700 may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. An apparatus comprising:

a processor;

a memory on which are stored machine readable instructions that when executed by the processor, cause the processor to:

access a property value respectively corresponding to each of a plurality of firing actuators in a printing system;

determine a count of the firing actuators having property values that are outside of a predefined threshold value range;

based on the count exceeding a predefined maximum threshold value, determine locations of the plurality of the firing actuators having property values that are outside of the predefined threshold value range;

determine a standard deviation of the determined locations; and based on the determined standard deviation being below a predetermined threshold, output an indication concerning a potential printhead strike.

2. The apparatus of claim 1, wherein the instructions are further to cause the processor to, based on the determined standard deviation of the determined locations being above the predetermined threshold, determine that a potential printhead strike has not occurred.

3. The apparatus of claim 1, wherein the firing actuators are housed in a plurality of printheads of the printing system and wherein at least two of the printheads are arranged at different down-web or down-object locations of the printing system with respect to each other.

4. The apparatus of claim 1, wherein the firing actuators comprise one of thermal inkjet resistors or piezoelectric elements and wherein the property value comprises one of a resistance value of a thermal inkjet resistor or a capacitance value of a piezoelectric element.

5. The apparatus of claim 1, wherein the instructions are further to cause the processor to:

access the property values of the plurality of firing actuators at multiple time periods;

for each of the multiple time periods, track changes to the property values;

determine rates at which the property values have changed over the multiple time periods; and use the determined rates in determining whether to output the indication concerning the potential printhead strike.

6. The apparatus of claim 1, wherein the printing system is one of a web press printing system, three-dimensional printing system, a desktop printing system, a sheet fed printing system, a direct to corrugate printing system, a direct to object printing system, or a multifunction printing system.

7. The apparatus of claim 1, wherein to output the indication, the instructions are further to cause the processor to at least one of output a notification of the potential printhead strike, output an instruction to instruct an operator to stop a printing operation, or output an instruction that stops the printing operation.

8. A method comprising:

accessing, by a processor, a property value corresponding to each of a plurality of actuators;

determining, by the processor, whether any of the property values is outside of a predefined threshold value;

based on a determination that a plurality of the property values are outside of the predefined threshold value, identifying, by the processor, the actuators to which the plurality of property values that are outside of the predefined threshold value correspond;

determining, by the processor, locations of the identified actuators;

determining, by the processor, a location pattern formed by the identified actuators;

determining, by the processor, whether the location pattern meets a predefined location pattern that is indicative of a head strike; and based on a determination that the location pattern meets the predefined location pattern, outputting an indication concerning a potential head strike.

9. The method of claim 8, further comprising:

accessing the property value corresponding to each of a plurality of actuators of multiple printheads;

wherein identifying the actuators to which the plurality of property values that are outside of the predefined threshold value correspond further comprises identifying the actuators in a plurality of multiple printheads; and wherein determining a location pattern further comprises determining a location pattern formed by the identified actuators in the plurality of multiple printheads.

10. The method of claim 9, wherein the predefined location pattern comprises a pattern that extends across actuators in a plurality of the multiple printheads that are arranged along a down-web or down-object direction with respect to each other.

11. The method of claim 8, further comprising:

accessing the property values of the plurality of actuators at multiple time periods;

for each of the multiple time periods, tracking changes to the property values;

determining rates at which the property values have changed over the multiple time periods; and use the determined rates in determining whether to output the instruction concerning the potential printhead strike.

12. The method of claim 8, wherein outputting the indication concerning the potential printhead strike comprises at least one of outputting a notification of the potential printhead strike, outputting an instruction to instruct an operator to stop a printing operation, or outputting an instruction that stops the printing operation.

13. The method of claim 8, wherein determining whether the location pattern meets the predefined location pattern further comprises:

comparing the location pattern with a plurality of predefined location patterns that are indicative of a head strike;

determine whether the location pattern is within a predetermined difference range with respect to any of the plurality of predefined location patterns; and determine that the location pattern meets the predefined location pattern based on a determination that the location pattern is within a predetermined difference range with respect to one of the plurality of predefined location patterns.

14. A printing system comprising:

a printhead having a plurality of firing actuators;

a sensor to measure a property value corresponding to each of the plurality of firing actuators; and a controller to:

determine a count of the firing actuators having property values that are outside of a predefined threshold value range;

based on the count exceeding a predefined maximum threshold value, determine locations of the plurality of the firing actuators;

determine a standard deviation of the determined locations; and based on the determined standard deviation being below a predetermined threshold, output an indication concerning a potential printhead strike.

15. The printing system of claim 14, wherein the controller is further to, based on the determined standard deviation of the determined locations being above the predetermined threshold, determine that the potential printhead strike has not occurred.

* * * * *